US006023017A

United States Patent [19]

Minowa et al.

[11] Patent Number: 6,023,017

[45] Date of Patent: Feb. 8, 2000

[54] MUSICAL PERFORMANCE ASSISTING SYSTEM AND STORAGE MEDIUM STORING MUSICAL PERFORMANCE ASSISTING PROGRAM

[75] Inventors: Masafumi Minowa; Shu Eitaki, both of Hamamatsu, Japan

[73] Assignee: Kabushiki Kaisha Kawai Gakki Seisakusho, Shizuoka-ken, Japan

[21] Appl. No.: 09/217,171

[22] Filed: Dec. 21, 1998

[30] Foreign Application Priority Data

Dec. 26, 1997 [JP] Japan ..... 9-366879

[51] Int. Cl.[7] ..... G10H 1/38

[52] U.S. Cl. ..... 84/637; 84/DIG. 22

[58] Field of Search ..... 84/613, 637, 650–652, 84/669, DIG. 22

[56] References Cited

U.S. PATENT DOCUMENTS 5,179,241 1/1993 Okuda et al. ..... 84/613
5,481,066 1/1996 Kitamura ..... 84/637
5,502,275 3/1996 Kondo et al. ..... 84/637 X
5,723,803 3/1998 Kurakake ..... 84/637

*Primary Examiner*—Stanley J. Witkowski
*Attorney, Agent, or Firm*—Christie, Parker & Hale, LLP

[57] ABSTRACT

A musical performance assisting system includes a key designating section for designating a key of music, a chord designating section for designating a chord in the music, a chord file storing pointers in a manner so as to correspond to keys of music, and a chord tone file storing the pointers in a manner so as to correspond to chord groups, each of the chord groups including chord tone data of chords belonging thereto. The system further includes a chord tone selecting section for selecting one of the pointers from the chord file based on the key designated by the key designating section and further selecting, from the chord tone file, chord tone data of one of the chords which belongs to one of the chord groups designated by the selected pointer and which is designated by the chord designating section. The system further includes a musical tone generating section for producing a musical tone corresponding to the chord tone data selected by the chord tone selecting section.

24 Claims, 5 Drawing Sheets

MUSICAL PERFORMANCE ASSISTING SYSTEM AND STORAGE MEDIUM STORING MUSICAL PERFORMANCE ASSISTING PROGRAM

BACKGROUND OF THE INVENTION

1. FIELD OF THE INVENTION

The present invention relates to a musical performance assisting technique for assisting a player of an electronic musical instrument in playing music.

2. DESCRIPTION OF THE RELATED ART

The musical performance assisting technique has been applied to electronic musical instruments, such as electronic pianos.

In FIG. 7, (a) shows diatonic chords in the key of C major and (b) shows diatonic chords in the key of C minor. According to the conventional musical performance assisting technique, for example, when a C keyboard key is pressed, a C major chord is sounded, on the other hand, for sounding a C minor chord, it is necessary to simultaneously press a C keyboard key and an E flat key, i.e. a minor third key, and further, for sounding a Cm7 chord, it is necessary to simultaneously press three keyboard keys, i.e. a C key, a minor third key and a minor seventh key. Through these key pressing operations, the corresponding chords are designated, respectively.

Accordingly, in the foregoing conventional chord designation, knowledge about distinction between minor and major chords and further about chord tones thereof is required. Moreover, for sounding a tension chord, knowledge about additional chord tones is required.

Further, in general, types of chords to be used are almost determined according to the key of music. Thus, if a chord different from those chords is played, sound may become unnatural as if the key is changed. Therefore, for the natural chord progression, musical knowledge is essential.

SUMMARY OF THE INVENTION

Therefore, it is an object of the present invention to provide a musical performance assisting system which enables a player, without requiring particular musical knowledge, to play music with natural sound through a simple operation.

It is another object of the present invention to provide a storage medium storing a musical performance assisting program readable by a computer for realizing the foregoing musical performance assisting system using the computer.

According to a first aspect of the present invention, there is provided a musical performance assisting system comprising a key designating section for designating a key of music; a chord designating section for designating a chord in the music; a chord file storing pointers in a manner so as to correspond to keys of music; a chord tone file storing the pointers in a manner so as to correspond to chord groups, each of the chord groups including chord tone data of chords belonging thereto; a chord tone selecting section for selecting one of the pointers from the chord file based on the key designated by the key designating section and further selecting, from the chord tone file, chord tone data of one of the chords which belongs to one of the chord groups designated by the selected pointer and which is designated by the chord designating section; and a musical tone generating section for producing a musical tone corresponding to the chord tone data selected by the chord tone selecting section.

According to a second aspect of the present invention, there is provided a musical performance assisting system comprising a key designating section for designating a key of music; a chord designating section for designating a chord in the music; a chord file storing pointer groups in a manner so as to correspond to keys of music, each of the pointer groups including pointers; a chord tone file storing the pointers in a manner so as to correspond to chords, each of the chords including corresponding chord tone data; a chord tone selecting section for selecting one of the pointer groups from the chord file based on the key designated by the key designating section and further selecting, from the chord tone file, chord tone data of one of the chords designated by one of the pointers of the selected pointer group and further designated by the chord designating section; and a musical tone generating section for producing a musical tone corresponding to the chord tone data selected by the chord tone selecting section.

In each of the foregoing first and second aspects, it may be arranged that the chord tone file stores roots corresponding to the chords as indexes, respectively, and the chord designating section designates one of the chords using corresponding one of the roots, and that the chord tone selecting section selects the chord tone data of one of the chords from the chord tone file using corresponding one of the roots.

In each of the foregoing first and second aspects, it may be arranged that the chord tone file stores the chord tone data of the chords for only one basic major key and one basic minor key, and that the chord tone selecting section, depending on the key designated by the key designating section, shifts pitches of the chord tone data of the chords for corresponding one of the basic major key and the basic minor key so as to use them as chord tone data of chords for the designated key.

In each of the foregoing first and second aspects, it may be arranged that the chord tone file stores the chord tone data of the chords for only major or minor keys and, when the key designated by the key designating section is a minor or major key which is opposite to the major or minor keys, the chord tone selecting section, depending on the designated key, shifts down or up tonics of the chord tone data of the chords for the corresponding key by minor three degrees so as to use them as chord tone data of chords for the designated key.

According to a third aspect of the present invention, there is provided a storage medium storing a musical performance assisting program readable by a computer, the program, when executed by the computer, allowing the computer to function as a key designating means for designating a key of music; a chord designating means for designating a chord in the music; a chord storing means for storing pointers in a manner so as to correspond to keys of music; a chord tone storing means for storing the pointers in a manner so as to correspond to chord groups, each of the chord groups including chord tone data of chords belonging thereto; a chord tone selecting means for selecting one of the pointers from the chord storing means based on the key designated by the key designating means and further selecting, from the chord tone storing means, chord tone data of one of the chords which belongs to one of the chord groups designated by the selected pointer and which is designated by the chord designating means; and a musical tone generating means for producing a musical tone corresponding to the chord tone data selected by the chord tone selecting means.

According to a fourth aspect of the present invention, there is provided a storage medium storing a musical performance assisting program readable by a computer, the program, when executed by the computer, allowing the computer to function as a key designating means for designating a key of music; a chord designating means for designating a chord in the music; a chord storing means for storing pointer groups in a manner so as to correspond to keys of music, each of the pointer groups including pointers; a chord tone storing means for storing the pointers in a manner so as to correspond to chords, each of the chords including corresponding chord tone data; a chord tone selecting means for selecting one of the pointer groups from the chord storing means based on the key designated by the key designating means and further selecting, from the chord tone storing means, chord tone data of one of the chords designated by one of the pointers of the selected pointer group and further designated by the chord designating means; and a musical tone generating means for producing a musical tone corresponding to the chord tone data selected by the chord tone selecting means.

In each of the foregoing third and fourth aspects, it may be arranged that the chord tone storing means stores roots corresponding to the chords as indexes, respectively, and the chord designating means designates one of the chords using corresponding one of the roots, and that the chord tone selecting means selects the chord tone data of one of the chords from the chord tone storing means using corresponding one of the roots.

In each of the foregoing third and fourth aspects, it may be arranged that the chord tone storing means stores the chord tone data of the chords for only one basic major key and one basic minor key, and that the chord tone selecting means, depending on the key designated by the key designating means, shifts pitches of the chord tone data of the chords for corresponding one of the basic major key and the basic minor key so as to use them as chord tone data of chords for the designated key.

In each of the foregoing third and fourth aspects, it may be arranged that the chord tone storing means stores the chord tone data of the chords for only major or minor keys and, when the key designated by the key designating means is a minor or major key which is opposite to the major or minor keys, the chord tone selecting means, depending on the designated key, shifts down or up tonics of the chord tone data of the chords for the corresponding key by minor three degrees so as to use them as chord tone data of chords for the designated key.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings.

Figure 1:
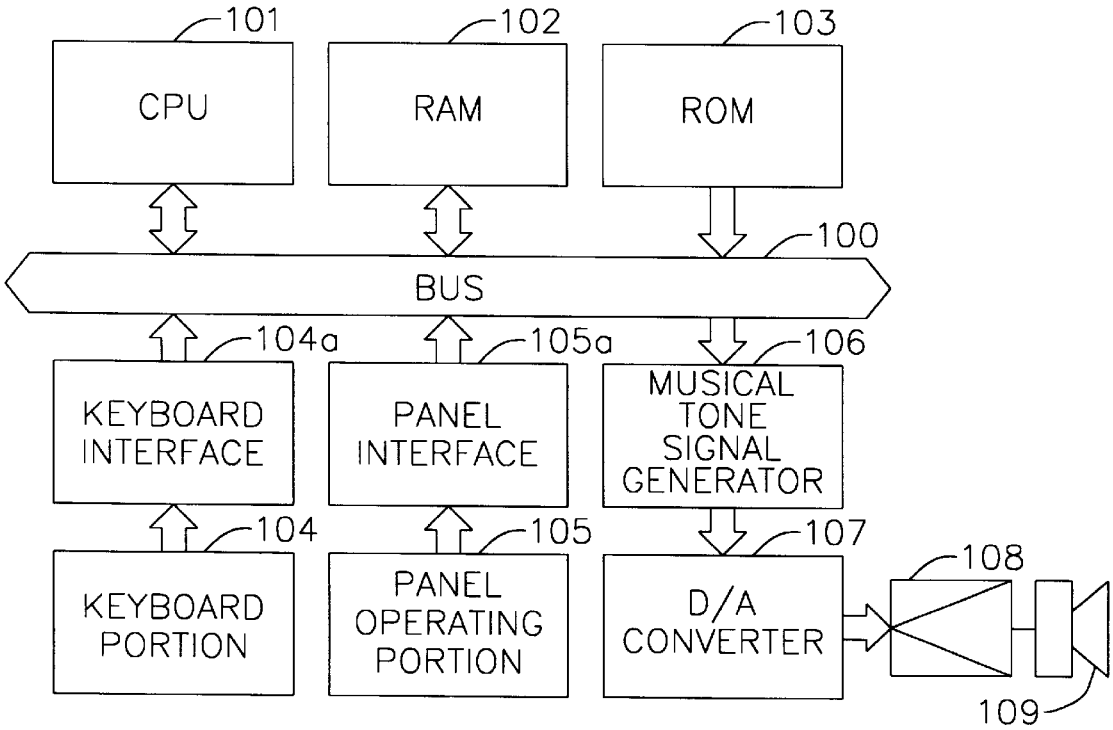
FIG. 1 is a block diagram showing a structure of an electronic musical instrument using a musical performance assisting system according to a first preferred embodiment of the present invention.

FIG. 1 shows an electronic musical instrument using a musical performance assisting system according to the first preferred embodiment of the present invention.

In FIG. 1, a CPU 101, a RAM 102, a ROM 103, a keyboard portion 104, a panel operating portion 105 and a musical tone signal generator 106 are connected to a bus 100 so that various commands and data are exchanged among them. As shown in FIG. 1, the keyboard portion 104 and the panel operating portion 105 are connected to the bus 100 via a keyboard interface 104*a* and a panel interface 105*a*, respectively. The keyboard portion 104 allows a player to input key-on/off data using keyboard keys. The panel operating portion 105 is provided with various panel switches including key designating switches for designating the corresponding keys of music. Further, to the musical tone signal generator 106 are connected in turn a D/A converter 107 for converting digital musical tone signals generated at the musical tone signal generator 106 into analog musical tone signals, an amplifier 108 for amplifying the analog musical tone signals from the D/A converter 107, and a reproducing device 109, such as a loudspeaker, for producing sounds to the exterior.

Figure 2:
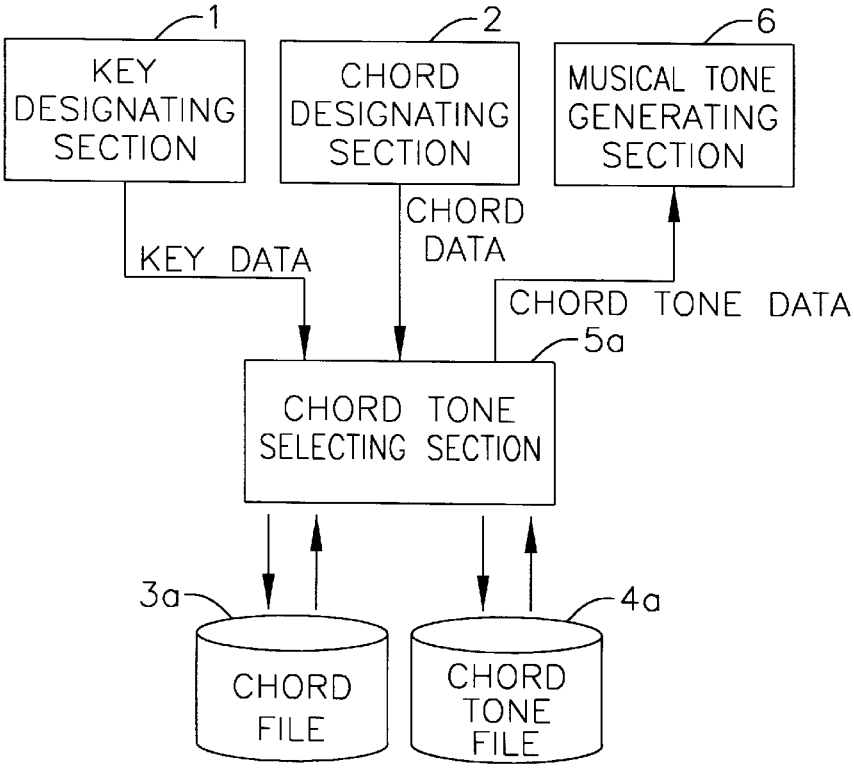
FIG. 2 is a functional block diagram of the musical performance assisting system according to the first preferred embodiment of the present invention.

FIG. 2 is a functional block diagram of the musical performance assisting system according to this embodiment. As shown in FIG. 2, the musical performance assisting system comprises a key designating section 1 for designating the keys of music, a chord designating section 2 for designating chords while music is played, a chord file 3*a*, a chord tone file 4*a*, a chord tone selecting section 5*a* and a musical tone generating section 6.

The key designating section 1 is realized by the panel operating portion 105 and provided with the foregoing key designating switches. Accordingly, when, for example, a C major designating switch is pressed, the C major key is designated. The key designating section 1 outputs a corresponding key designating signal via the bus 100 to the chord tone selecting section 5*a* realized by the CPU 101. The key designating section 1 may be in the form of a touch screen. On the other hand, the key designating section 1 may also be realized by a part of the keys of the keyboard portion 104. In this case, a plurality of keyboard keys may be pressed for designating the key of music. For example, for designating the C minor key, a first C keyboard key and a minor third E flat key may be simultaneously pressed.

The chord designating section 2 is realized by a part of the keys of the keyboard portion 104. As described later, the chord tone file 4*a* has root data corresponding to chords as indexes, respectively. Accordingly, by pressing one of the given keyboard keys representing a root, the corresponding chord can be designated. For example, when designating a Cmaj7 chord, it is sufficient to press only a C keyboard key being a root. The chord designating section 2 outputs a corresponding chord designating signal via the bus 100 to the chord tone selecting section 5*a* realized by the CPU 101.

Figure 3:
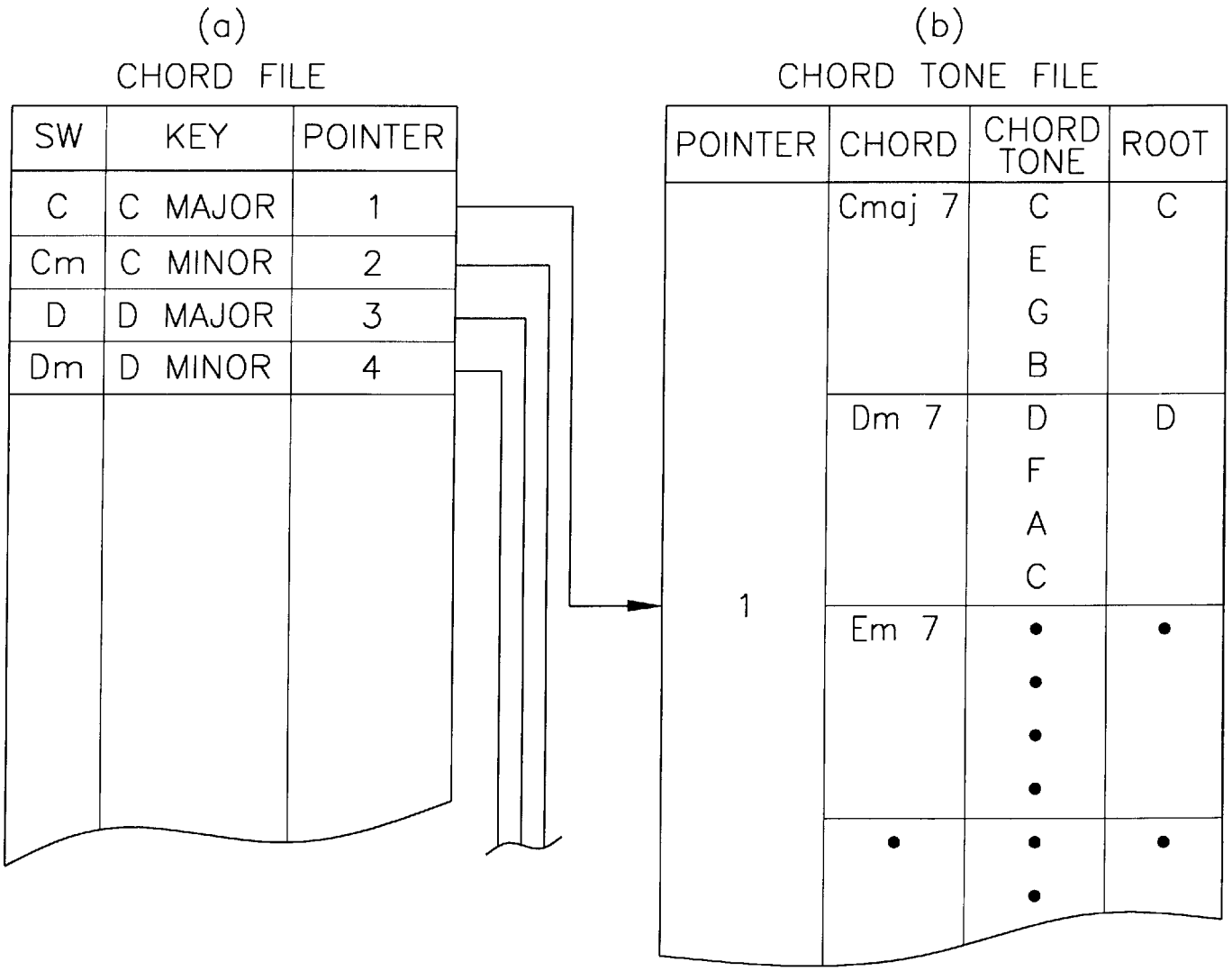
FIG. 3 is a diagram for explaining a chord file and a chord tone file shown In FIG. 2.

The chord file 3*a* is normally stored in the ROM 103 and loaded into the RAM 102 after the electronic musical instrument is switched on to finish initialization. As shown at (a) in FIG. 3, the chord file 3*a* is a table storing pointers in a manner so as to correspond to the key designating switches (SW) of the key designating section 1, i.e. the keys to be designated by the key designating switches (SW).

Like the chord file 3*a*, the chord tone file 4*a* is normally stored in the ROM 103 and loaded into the RAM 102 after the electronic musical instrument is switched on to finish initialization. As shown at (b) in FIG. 3, the chord tone file 4*a* is a table storing the foregoing pointers in a manner so as to correspond to chord groups, respectively. Each of the chord groups includes chord tone data of given chords. Further, the chord tone file 4*a* stores the root data corresponding to each of the chords as described above, so that one of the chords, i.e. the chord tones thereof, can be selected using a corresponding root.

The chord tone selecting section 5*a* is realized by the CPU 101 when executing a control program stored in the ROM 103. Specifically, when a player presses one of the key designating switches of the key designating section 1 and then presses one of the given keyboard keys of the chord designating section 2, the chord tone selecting section 5*a* selects corresponding one of the pointers from the chord file 3*a* (for example, at (a) in FIG. 3, if the C major key is designated, a pointer 1 is selected), then selects from the chord tone file 4*a* chord tone data of a chord which belongs to a chord group designated by the selected pointer and which is designated by the chord designating section 2 (for example, at (b) in FIG. 3, if a C keyboard key is pressed to designate a Cmaj7 chord, chord tones C, E, G and B are selected). The chord tone selecting section 5*a* outputs the selected chord tone data to the musical tone generating section 6.

The musical tone generating section 6 is realized by the musical tone signal generator 106, the D/A converter 107, the amplifier 108 and the reproducing device 109, and produces a musical tone, i.e. a chord, corresponding to the chord tone data inputted from the chord tone selecting section 5*a* via the bus 100.

Now, an operation of the electronic musical instrument having the foregoing structure will be described with reference to FIG. 4.

Figure 4:
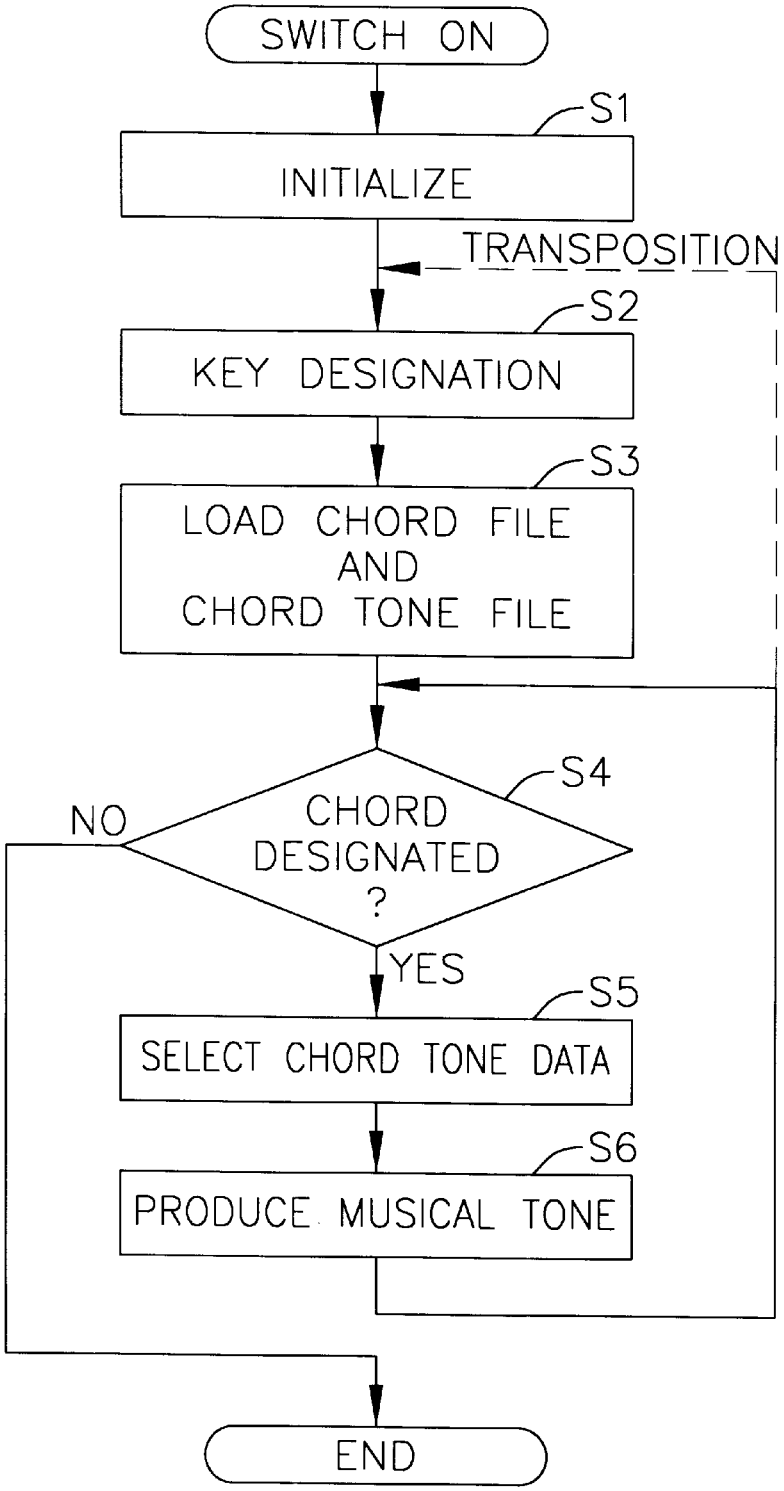
FIG. 4 is a diagram for explaining an operation of the electronic musical instrument shown in FIGS. 1 and 2.

As shown in FIG. 4, when the electronic musical instrument is switched on, initialization is executed at step S1. Then at step S2, when the key of music is designated by a player via the key designating section 1, i.e. when the player presses one of the key designating switches, a corresponding key designating signal is outputted to the chord tone selecting section Sa via the bus 100. Key designation is normally performed at the start of playing music but, if a change of key (transposition) is carried out, key designation is performed even while music is played. Transposition may be carried out by pressing one of the key designating switches while playing music or by pressing a plurality of keyboard keys, as described above, while playing music. Then at step S3, the chord file 3*a* and the chord tone file 4*a* are read from the ROM 103 and loaded into the RAM 102. Then at step S4, if a chord is designated by the player via the chord designating section 2, i.e. if the player presses one of the given keyboard keys, a corresponding chord designating signal is outputted to the chord tone selecting section 5*a* via the bus 100. As described above, in this embodiment, chord designation can be performed by designating only a root of a corresponding chord. Accordingly, when designating, for example, a Cmaj7 chord in the key of C major, this can be achieved only by pressing a C keyboard key. Then at step S5, the chord tone selecting section 5*a* selects corresponding one of the pointers from the chord file 3*a* based on the inputted key designating signal, then selects from the chord tone file 4*a* chord tone data of a chord which belongs to a chord group designated by the selected pointer and which is designated by the inputted chord designating signal. For example, if the C major key is designated, a pointer 1 is selected from the chord file 3*a*, and further, if a Cmaj7 chord in a chord group designated by the pointer 1 is designated, chord tones C, E, G and B are selected from the chord tone file 4*a*. Then at step S6, the selected chord tone data is outputted to the musical tone generating section 6 where a corresponding chord is sounded. Then, the operation returns to step S4 to repeat steps S4 to S6 until no chord designation is detected at step S4. On the other hand, when the key is changed as described above, the operation returns to step S2 to perform key designation.

Figure 5:
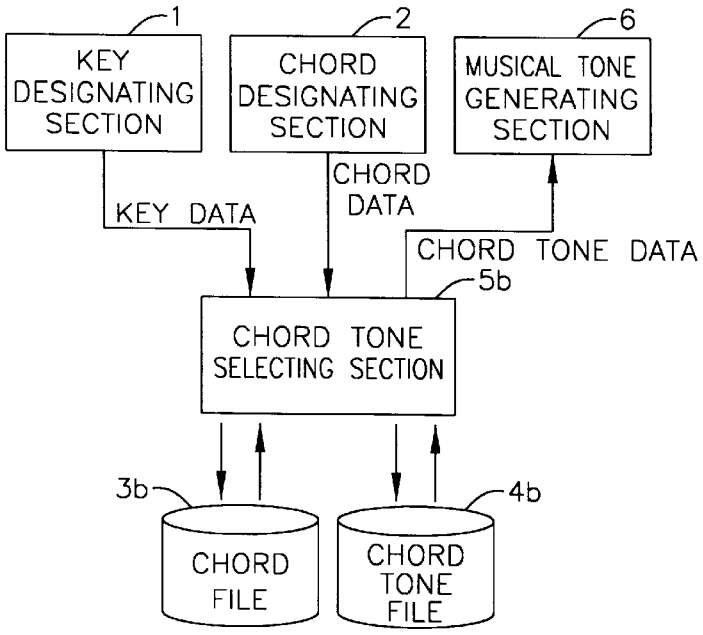
FIG. 5 is a functional block diagram of a musical performance assisting system according to a second preferred embodiment of the present invention.
Figure 7:
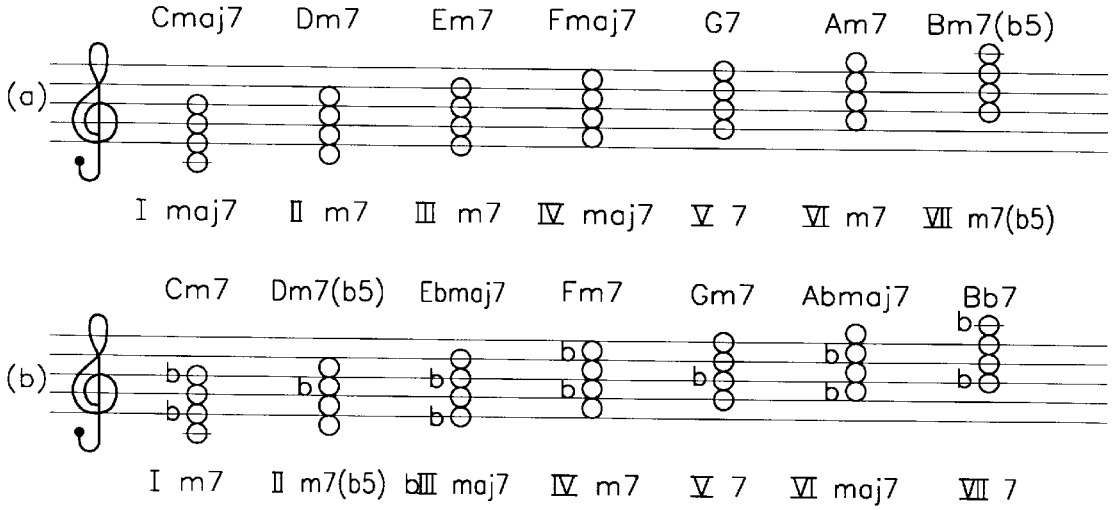
FIG. 7 is a diagram showing diatonic chords in the keys of C major and C minor, respectively.
Figure 6:
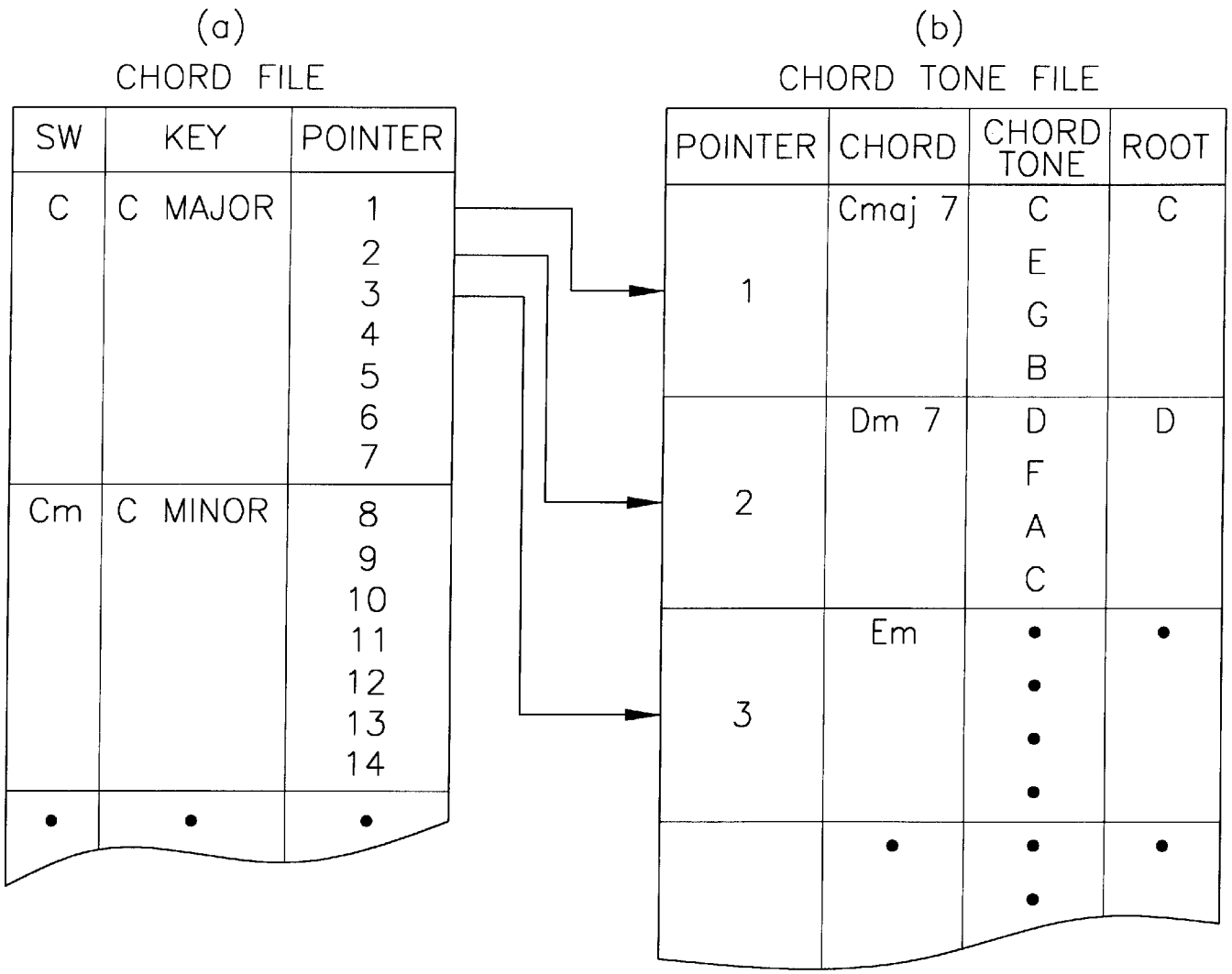
FIG. 6 is a diagram for explaining a chord file and a chord tone file shown in FIG. 5.

FIG. 5 is a functional block diagram of a musical performance assisting system according to the second preferred embodiment of the present invention. The second preferred embodiment differs from the first preferred embodiment only in structures of a chord file 3*b*, a chord tone file 4*b* and a chord tone selecting section 5*b*. The other structure of the second preferred embodiment is the same as that of the first preferred embodiment. Specifically, as shown at (a) in FIG. 6. the chord file 3*b* stores pointer groups in a manner so as to correspond to the key designating switches (SW) of the key designating section 1. i.e. the keys to be designated by the key designating switches (SW), and each of the pointer groups includes pointers. On the other hand, as shown at (b) in FIG. 6, the chord tone file 4*b* stores the foregoing pointers in a manner so as to correspond to chords, respectively. Each of the chords includes corresponding chord tone data. Like the chord tone file 4*a*, the chord tone file 4*b* stores root data corresponding to each of the chords, so that one of the chords, i.e. the chord tones thereof, can be selected using a corresponding root. Since the pointers correspond to the chords one by one in the chord tone file 4*b*, it is not necessary that the chord tone file 4*b* stores all the chords per key, i.e. it is not necessary that the chord tone file 4*b* separately stores those chords which overlap with each other in the different keys. Following the foregoing structures of the chord file 3*b* and the chord tone file 4*b*, the chord tone selecting section 5*b* functions to select corresponding one of the pointer groups from the chord from 3*b* based on key designation via the key designating section 1 and then select from the chord tone file 4*b* chord tone data of a chord designated by one of the pointers in the selected pointer group and further designated via the chord designating section 2. The other operation is the same as that of the first preferred embodiment.

In each of the foregoing first and second preferred embodiments, it may be arranged that the chord tone file 4*a* or 4*b* has chord tone data, i.e. chord tones, of chords for only the basic major key and the basic minor key. Then, depending on the key designated by the key designating section 1, the chord tone selecting section 5*a* or 5*b* shifts pitches of the chord tones of the chords for one of the basic keys (i.e. the basic major key when the major key is designated, or the basic minor key when the minor key is designated) so as to use them as chord tone data of chords for the designated key. Specifically, by deriving degrees between the basic key and the designated key, the pitch shift magnitude is determined so that the pitch-shifted data can be used as chord tone data for the designated key. This can reduce required data storing regions of the RAM 102 and the ROM 103.

Further, in each of the foregoing first and second preferred embodiments, it may be arranged that the chord tone file 4*a* or 4*b* has chord tone data, i.e. chord tones, of chords for only the major keys or the minor keys. Then, if the key designated by the key designating section 1 is a minor key or a major key which is opposite to the foregoing major keys or the minor keys, the chord tone selecting section 5*a* or 5*b*, depending on the designated key, shifts down or up tonics of the chord tones of the chords for the corresponding key by minor three degrees so as to use them as chord tone data of chords for the designated key. Specifically, since chords for the major key are the same as those for the minor key which is shifted down by minor three degrees, if the designated key is opposite to the stored major or minor keys, the required chord tone data can be obtained by shifting down or up tonics of chord tones of chords for the corresponding key by minor three degrees. This can also reduce required data storing regions of the RAM 102 and the ROM 103.

The musical performance assisting system in each of the foregoing first and second preferred embodiments may be realized by a computer and a storage medium, such as a flexible disk or a CD-ROM, storing a musical performance assisting program which, when executed by the computer, allows the computer to serve as means for performing the foregoing functions of the system. In practice, a keyboard, a tone generator, an amplifier, a loudspeaker, etc. are connected to the computer via a MIDI or the like. In this case, for example, by clicking an icon appearing on a display screen, the key may be designated. Naturally, a part of keys of the keyboard may be used for designating the key. Chord designation may also be carried out by using a part of the keyboard keys. The chord file and the chord tone file may be stored in a hard disk and loaded into a RAM of the computer, and the chord tone selecting section may be realized by a CPU of the computer. Further, the musical tone generating section may be realized by the tone generator, the amplifier and the loudspeaker connected to the computer.

While the present invention has been described in terms of the preferred embodiments, the invention is not to be limited thereto, but can be embodied in various ways without departing from the principle of the invention as defined in the appended claims.

What is claimed is:

1. A musical performance assisting system comprising:

a key designating section designating a key of music;

a chord designating section designating a chord in the key of music;

a chord file storing keys of music and pointers in a manner so as to correspond the keys of music to the pointers stored;

a chord tone file storing said pointers in a manner so as to correspond chord groups to the pointers stored, each of said chord groups including chord tone data of chords belonging thereto;

a chord tone selecting section selecting one of said pointers from said chord file based on the key of music designated by said key designating section and further selecting, from said chord tone file, chord tone data of one of said chords which belongs to one of said chord groups designated by the selected pointer and which is designated by said chord designating section; and a musical tone generating section producing a musical tone corresponding to said chord tone data selected by said chord tone selecting section.

2. The musical performance assisting system according to claim 1, wherein said chord tone file stores roots corresponding to the chords as indexes, respectively, and said chord designating section designates one of the chords using corresponding one of said roots, and wherein said chord tone selecting section selects the chord tone data of one of the chords from said chord tone file using corresponding one of said roots.

3. The musical performance assisting system according to claim 1, wherein said chord tone file stores the chord tone data of the chords for only one basic major key and one basic minor key, and wherein said chord tone selecting section, depending on the key designated by said key designating section, shifts pitches of the chord tone data of the chords for corresponding one of said basic major key and said basic minor key so as to use them as chord tone data of chords for the designated key.

4. The musical performance assisting system of claim 1 wherein the chord tone data of one of said chords is chord tone data of diatonic chords.

5. The musical performance assisting system of claim 1 wherein the key designating section comprises a plurality of switches in which each switch designates a different key of music.

6. A musical performance assisting system comprising:

a key designating section designating a key of music;

a chord designating section designating a chord in the key of music;

a chord file storing keys of music and pointer groups in a manner so as to correspond keys of music to the pointer groups stored, each of said pointed groups including pointers;

a chord tone file storing said pointers in a manner so as to correspond chords to the pointers stored, each of said chords including corresponding chord tone data;

a chord tone selecting section selecting one of said pointer groups from said chord file based on the key of music designated by said key designating section and further selecting, from said chord tone file, chord tone data of one of said chords designated by one of the pointers of said selected pointer group and further designated by said chord designating section; and a musical tone generating section producing a musical tone corresponding to said chord tone at a selected by said chord tone selecting section.

7. The musical performance assisting system according to claim 6, wherein said chord tone file stores roots corresponding to the chords as indexes, respectively, and said chord designating section designates one of the chords using corresponding one of said roots, and wherein said chord tone selecting section selects the chord tone data of one of the chords from said chord tone file using corresponding one of said roots.

8. The musical performance assisting system according to claim 6, wherein said chord tone file stores the chord tone data of the chords for only one basic major key and one basic minor key, and wherein said chord tone selecting section, depending on the key designated by said key designating section, shifts pitches of the chord tone data of the chords for corresponding one of said basic major key and said basic minor key so as to use them as chord tone data of chords for the designated key.

9. The musical performance assisting system according to claim 6, wherein said chord tone file stores the chord tone data of the chords for only major or minor keys and, when the key designated by said key designating section is a minor or major key which is opposite to said major or minor keys, said chord tone selecting section, depending on the designated key, shifts down or up tonics of the chord tone data of the chords for the corresponding key by minor three degrees so as to use them as chord tone data of chords for the designated key.

10. The musical performance assisting system of claim 6 wherein the chord tone data of one of said chords is chord tone data of diatonic chords.

11. The musical performance assisting system of claim 6 wherein the key designating section comprises a plurality of switches in which each switch designates a different key of music.

12. A storage medium storing a musical performance assisting program readable by a computer, said program, when executed by the computer, allowing the computer to function as:

a key designating means for designating a key of music;

a chord designating means for designating a chord in the key of music;

a chord storing means for storing keys of music and pointers in a manner so as to correspond keys of music to the pointers stored;

a chord tone storing means for storing said pointers in a manner so as to correspond chord groups to the pointers stored, each of said chord groups including chord tone data of chords belonging thereto;

a chord tone selecting means for selecting one of said pointers from said chord storing means based on the key of music designated by said key designating means and further selecting, from said chord tone storing means, chord tone data of one of said chords which belongs to one of said chord groups designated by the selected pointer and which is designated by said chord designating means; and a musical tone generating means for producing a musical tone corresponding to said chord tone data selected by said chord tone selecting means.

13. The storage medium according to claim 12, wherein said chord tone storing means stores roots corresponding to the chords as indexes, respectively, and said chord designating means designates one of the chords using corresponding one of said roots, and wherein said chord tone selecting means selects the chord tone data of one of the chords from said chord tone storing means using corresponding one of said roots.

14. The storage medium according to claim 12, wherein said chord tone storing means stores the chord tone data of the chords for only one basic major key and one basic minor key, and wherein said chord tone selecting means, depending on the key designated by said key designating means, shifts pitches of the chord tone data of the chords for corresponding one of said basic major key and said basic minor key so as to use them as chord tone data of chords for the designated key.

15. The storage medium according to claim 12, wherein said chord tone storing means stores the chord tone data of the chords for only major or minor keys and, when the key designated by said key designating means is a minor or major key which is opposite to said major or minor keys, said chord tone selecting means, depending on the designated key, shifts down or up tonics of the chord tone data of the chords for the corresponding key by minor three degrees so as to use them as chord tone data of chords for the designated key.

16. The storage medium of claim 12 wherein the chord tone data of one of said chords is chord tone data of diatonic chords.

17. The storage medium of claim 12 wherein the key designating means comprises a plurality of switches in which each switch designates a different key of music.

18. A storage medium storing a musical performance assisting program reachable by a computer, said program, when executed by the computer, allowing the computer to function as:

a key designating means for designating a key of music;

a chord designating means for designating a chord in the key of music;

a chord storing means for storing keys of music and pointer groups in a manner so as to correspond keys of music to the pointer groups stored, each of said pointer groups including pointers;

a chord tone storing means for storing said pointers in a manner so as to correspond chords to the pointers stored, each of said chords including corresponding chord tone data;

a chord tone selecting means for selecting one of said pointer groups from said chord storing means based on the key of music designated by said key designating means and further selecting, from said chord tone storing means, chord tone data of one of said chords designated by one of the pointers of said selected pointer group and further designated by said chord designating means; and a musical tone generating means for producing a musical tone corresponding to said chord tone data selected by said chord tone selecting means.

19. The storage medium according to claim 18, wherein said chord tone storing means stores roots corresponding to the chords as indexes, respectively, and said chord designating means designates one of the chords using corresponding one of said roots, and wherein said chord tone selecting means selects the chord tone data of one of the chords from said chord tone storing means using corresponding one of said roots.

20. The storage medium according to claim 18, wherein said chord tone storing means stores the chord tone data of the chords for only one basic major key and one basic minor key, and wherein said chord tone selecting means, depending on the key designated by said key designating means, shifts pitches of the chord tone data of the chords for corresponding one of said basic major key and said basic minor key so as to use them as chord tone data of chords for the designated key.

21. The storage medium according to claim 18, wherein said chord tone storing means stores the chord tone data of the chords for only major or minor keys and, when the key designated by said key designating means is a minor or major key which is opposite to said major or minor keys, said chord tone selecting means, depending on the designated key, shifts down or up tonics of the chord tone data of the chords for the corresponding key by minor three degrees so as to use them as chord tone data of chords for the designated key.

22. The storage medium of claim 18 wherein the chord tone data of one of said chords is chord tone data of diatonic chords.

23. The storage medium of claim wherein the key designating means comprises a plurality of switches in which each switch designates a different key of music.

24. A musical performance assisting system comprising:

a key designating section for designating a key of music;

a chord designating section for designating a chord in the music;

a chord file storing pointers in a manner so as to correspond to the keys of music;

a chord tone file storing said pointers in a manner so as to correspond to chord groups, each of said chord groups including chord tone data of chords belonging thereto;

a chord tone selecting section for selecting one of said pointers from said chord file based on the key designated by said key designating section and further selecting, from said chord tone file, chord tone data of one of said chords which belongs to one of said chord groups designated by the selected pointer and which is designated by said chord designating section; and a musical tone generating section for producing a musical tone corresponding to said chord tone data selected by said chord tone selecting section, wherein said chord tone file stores the chord tone data of the chords for only major or minor keys and, when the key designated by said key designating section is a minor or major key which is opposite to said major or minor keys, said chord tone selecting section, depending on the designated key, shifts down or up tonics of the chord tone data of the chords for the corresponding key by minor three degrees so as to use them as chord tone data of chords for the designated key.

* * * * *